United States Patent [19]

Ohtake et al.

[11] 4,095,748

[45] Jun. 20, 1978

[54] APPARATUS FOR MIXING A CEMENT SLURRY WITH A GLASS FIBER

[75] Inventors: Sadao Ohtake, Nishinomiya; Shiyuji Hayashida, Osaka; Takamasa Sanada, Settsu; Shigeki Terai, Kobe, all of Japan

[73] Assignee: Kanebo, Ltd., Japan

[21] Appl. No.: 701,652

[22] Filed: Jul. 1, 1976

[30] Foreign Application Priority Data

| | | |
|---|---|---|
| Jul. 4, 1975 | Japan | 50-81892 |
| Mar. 9, 1976 | Japan | 51-28566[U] |
| Apr. 20, 1976 | Japan | 51-49688[U] |

[51] Int. Cl.[2] ..... B05B 7/14

[52] U.S. Cl. ..... 239/419.3; 239/422; 239/427.3

[58] Field of Search ..... 239/298, 419.3, 424, 239/296, 422, 427.3; 118/303

[56] References Cited

U.S. PATENT DOCUMENTS

| | | | |
|---|---|---|---|
| 2,929,436 | 3/1960 | Hampshire | 118/303 X |
| 3,038,750 | 6/1962 | Nielsen | 239/296 X |
| 3,042,567 | 7/1962 | King | 239/298 X |
| 3,073,534 | 1/1963 | Hampshire | 239/424 X |
| 3,565,345 | 2/1971 | Moltzan | 239/419.3 X |

FOREIGN PATENT DOCUMENTS

| | | | |
|---|---|---|---|
| 2,316,463 | 10/1974 | Germany | 239/419.3 |
| 943,223 | 12/1963 | United Kingdom | 239/419.3 |

*Primary Examiner*—Joseph F. Peters, Jr.
*Assistant Examiner*—Michael Mar
*Attorney, Agent, or Firm*—Paul & Paul

[57] ABSTRACT

An apparatus for mixing a cement slurry with a glass fiber in order to produce a glass fiber reinforced cement, including a spray gun, apparatus for cutting the glass fiber and apparatus for feeding the cut fibers to the spray gun. The spray gun comprises a glass fiber supply passage, a cement slurry supply passage, an air introduction passage, a plurality of air introduction holes communicated with the air introduction passage for injecting compressed air into the cement slurry supply passage and a closing element having at least two injection holes communicated with the cement slurry supply passage. The cement slurry is injected together with the compressed air through the injection holes and is mixed with the cut glass fibers discharged from a discharge opening of the fiber supply passage.

9 Claims, 26 Drawing Figures

Fig. 5-a
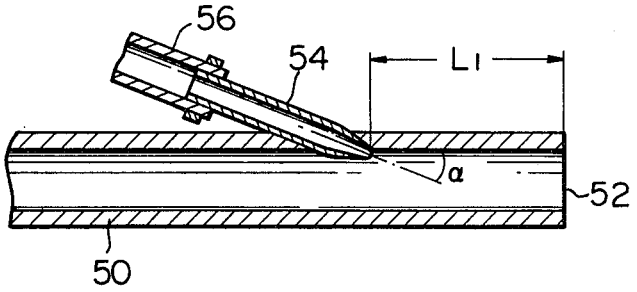
Fig. 5-b
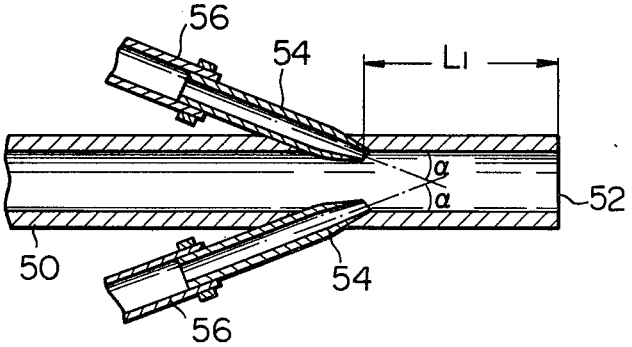
Fig. 5-c
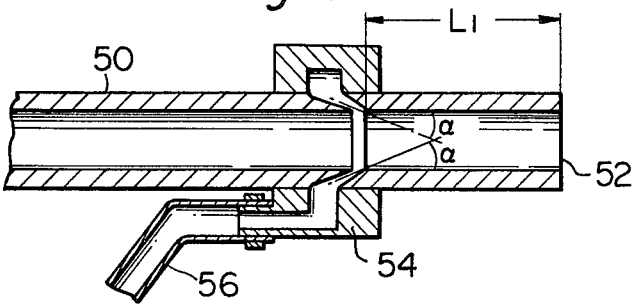

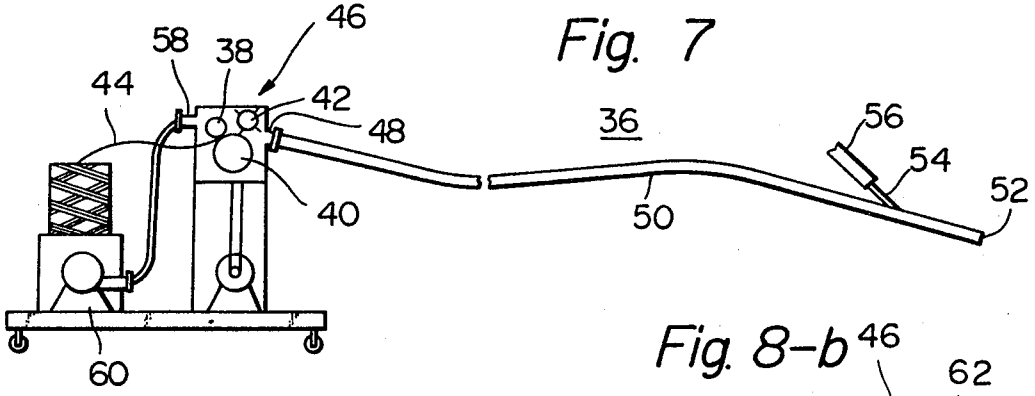
Fig. 7
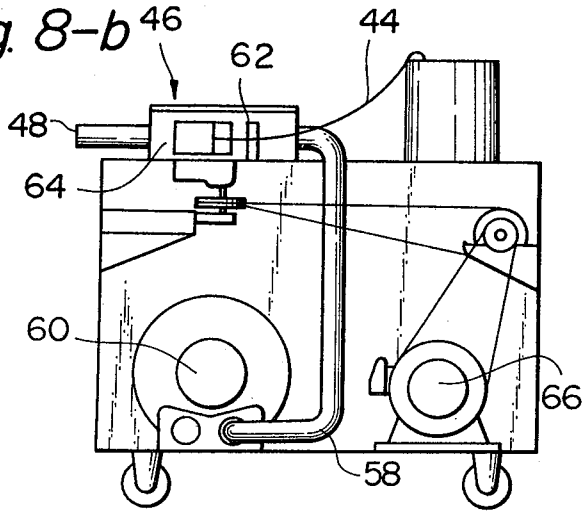
Fig. 8-b
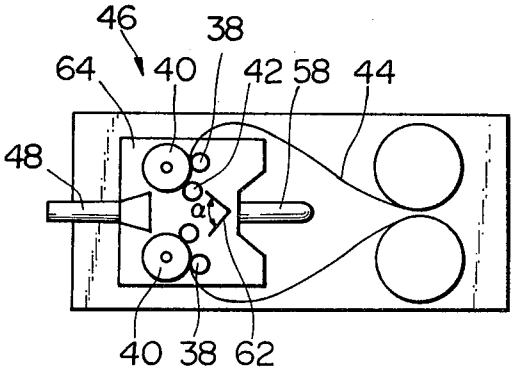
Fig. 8-a

APPARATUS FOR MIXING A CEMENT SLURRY WITH A GLASS FIBER

The present invention relates to an apparatus for mixing a cement slurry (for example, a slurry mixture of cement and water or a slurry mixture of cement, aggregate and water) with glass fiber. More particularly, the invention relates to an apparatus for forming a glass fiber-reinforced cement molded article (hereinafter referred to as "FRC") by discharging simultaneously a cement slurry and an alkali-resistant glass fiber to mix them homogeneously.

Recently, alkali-resistant glass fibers have been developed and FRC articles formed by dispersing and incorporating these glass fibers into cement slurries have attracted attention in the art. In general, cement molded article has a high compression strength but its tensile strength is relatively low. Accordingly, it has been carried out to produce FRC having high strength characteristics by incorporating into a cement a glass fiber having a high tensile strength in spite of a light weight.

As conventional methods for forming FRC, there can be mentioned a pre-mix method comprising mechanically agitating powdery cement or cement slurry with a glass fiber and molding the mixture, and a method comprising laminating a cement slurry and a glass fiber separately. In the pre-mix method, however, it is difficult to mix the cement and glass fiber homogeneously, and there is a defect that the glass fiber may be considerably damaged and a sufficient reinforcing effect can not be obtained. In the laminating method, the bonding area between the glass fiber and cement is very small and a sufficient reinforcing effect can not be obtained. As means for overcoming these defects, there has been proposed application of a so-called spray-up method to formation of FRC, which spray-up method has frequently been utilized for production of glass fiber-reinforced plastics, namely FRP. According to this spray-up method, an apparatus as disclosed in the first embodiment (FIG. 1) of the specification of British Pat. No. 1,360,803 is used. In this spray-up method, an injected stream of a cement slurry and a discharged stream of a glass fiber are separately formed by employing a spray gun for spraying a cement slurry and a glass fiber disperser for discharging a glass fiber cut into the prescribed length and both the streams are combined at a certain angle to mix them. The glass fiber discharging device used in this mixing method comprises an integrated assembly of a glass fiber-cutting mechanism and a discharge mechanism, and this device is of large dimension and its transportation or operation involves difficulties. In the second embodiment (FIG. 2) of said British patent specification, there is disclosed a spray device comprising an integrated assembly of a cement slurry spray mechanism and the above-mentioned glass fiber discharge device. In this second embodiment, however, the spray opening of the slurry spray mechanism has a ring-like shape and the width of the opening is narrow as compared with the section thereof. Accordingly, clogging or jamming is readily caused in the opening and a mixed stream homogeneous cannot be obtained throughout all the section of the opening. Therefore, this proposal has not been put practical use.

When the spray-up method which has frequently been used in formation of FRP is directly applied to the molding of FRC, the following serious problem is caused.

In the case of FRP, the glass fiber generally is incorporated in an amount of 30 to 50% by weight. In the case of FRC, however, in view of the raw material cost (the glass fiber is considerably more expensive than cement) and the reinforcing effect, it is desired that the glass fiber be incorporated in an amount of 0.5 to 15% by weight, especially 3 to 7% by weight. If the proportion of the glass fiber is thus reduced, when the injected stream of the cement slurry is combined with the discharged stream of the glass fiber, the glass fiber stream is splashed away by the injected stream of the cement slurry and it is impossible to disperse the glass fiber homogeneously and in a good condition into the cement slurry.

The present invention has now been completed as a result of the inventors' research conducted to solve the above problem and to overcome the other defects involved in the conventional techniques.

It is, therefore, a primary object of the present invention to provide an apparatus for mixing a cement slurry with an alkali-resistant glass fiber, in which a discharge stream of the glass fiber can be incorporated in a good condition into an injected or sprayed stream of the cement slurry even when the weight ratio of the glass fiber is low and the cement slurry can be mixed with the glass fiber homogeneously to obtain FRC having desirable properties.

In the present invention the above and other objects can be attained by an apparatus for mixing a cement slurry with a glass fiber, which comprises a double tube structure drum including an outer hollow cylinder and a glass fiber-feeding inner hollow cylinder, the top end of said inner cylinder being opened to form a glass fiber discharge opening and the top end of said outer cylinder disposed outside said discharge opening being closed, at least two injection holes formed on said closed face of the outer cylinder, a cement slurry supply passage formed in the outer cylinder to extend to said injection holes, and a compressed air introduction passage connected with said cement slurry supply passage in the vicinity of said injection holes.

In the apparatus of the present invention for mixing a cement slurry with a glass fiber, a glass fiber stream is discharged from a glass fiber discharge opening located at the center of a spray gun, spray streams of a cement slurry are injected from at least two injection holes disposed outside said glass fiber discharge opening, the cement slurry spray streams act on the glass fiber stream, and by the interreaction of these cement slurry streams, the glass fiber discharged stream is incorporated into the cement slurry spray streams in a good condition and a desirable homogeneous mixing state can be attained between the cement slurry and the glass fiber.

The present invention will now be described by reference to preferred examples illustrated in the accompanying drawings, in which:

FIGS. 4, 6 and 7 are simplified side views showing glass fiber cutting and feeding means that can be preferably applied to the apparatus of the present invention;

Figure 9:
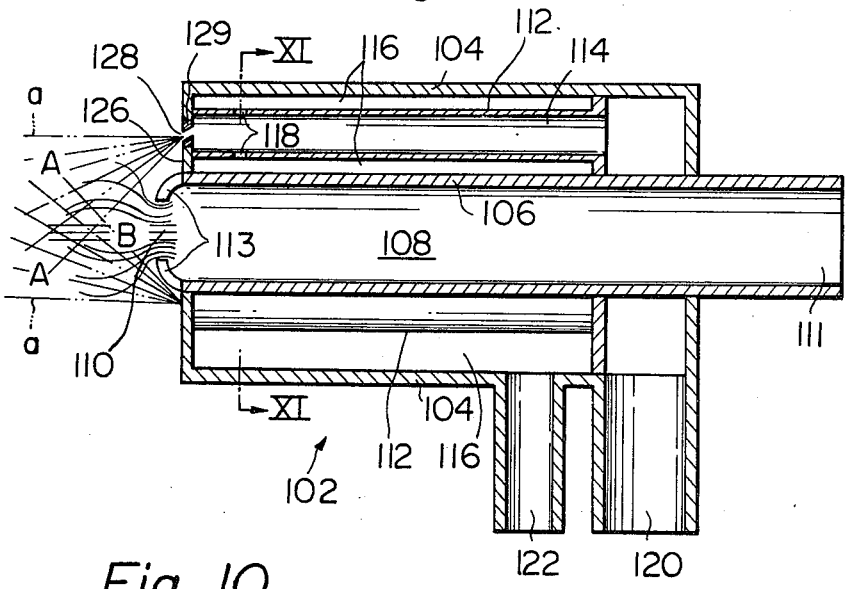
Figure 10:
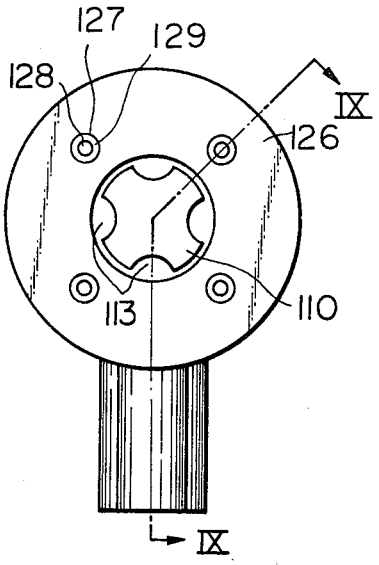
Figure 11:
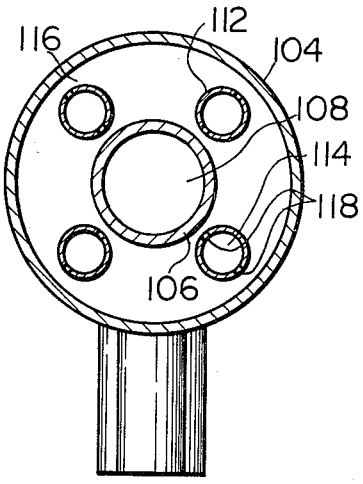
Figure 12:
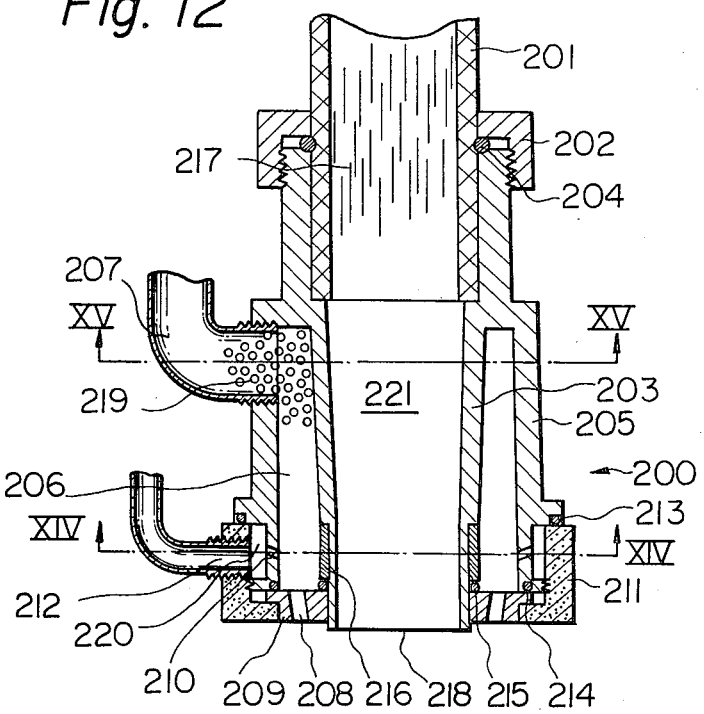
Figure 13:
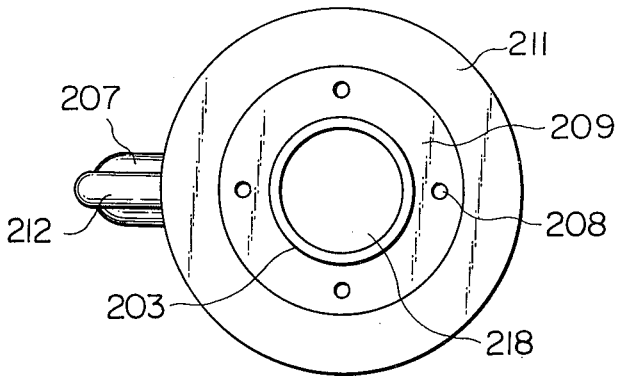
Figure 14:
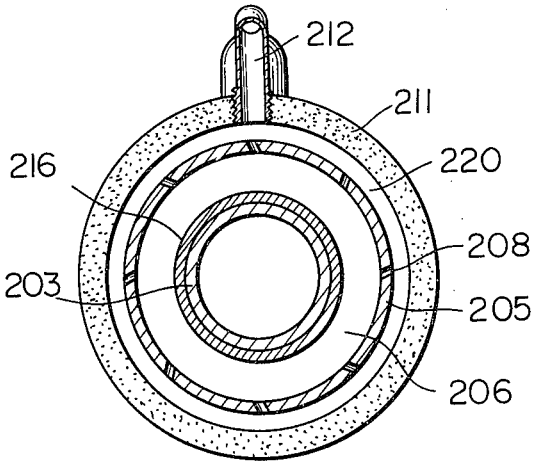
Figure 15:
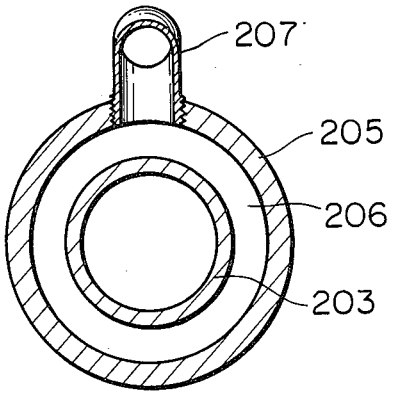
Figure 16:
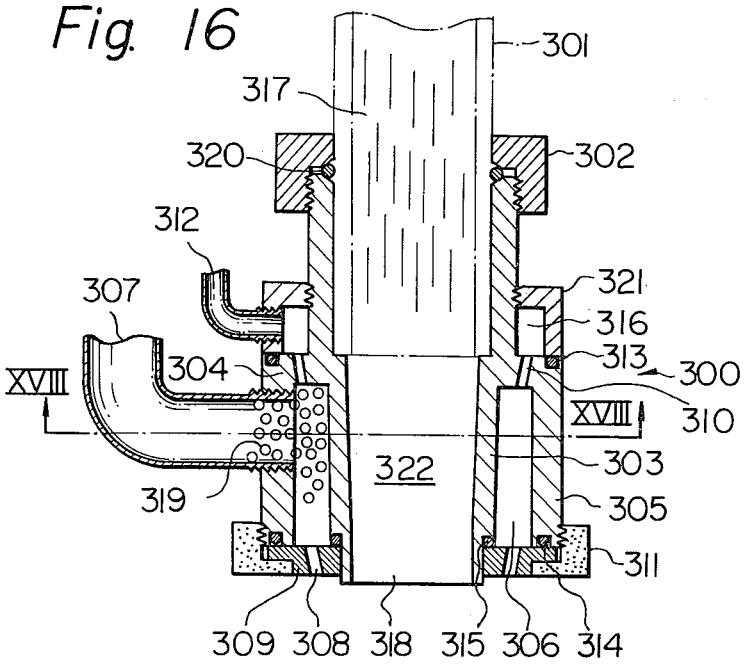
Figure 17:
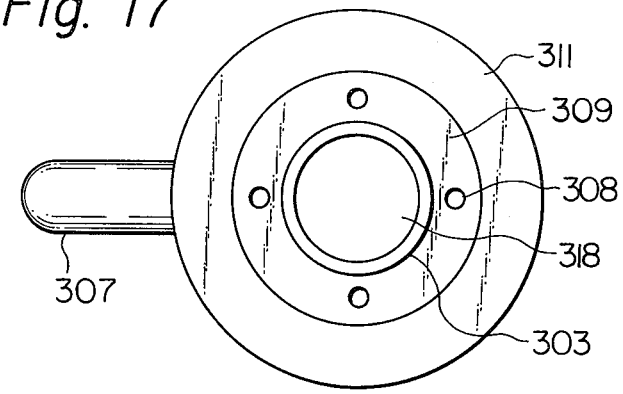
Figure 18:
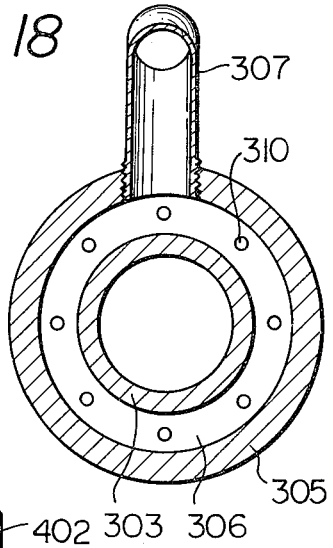
Figure 19:
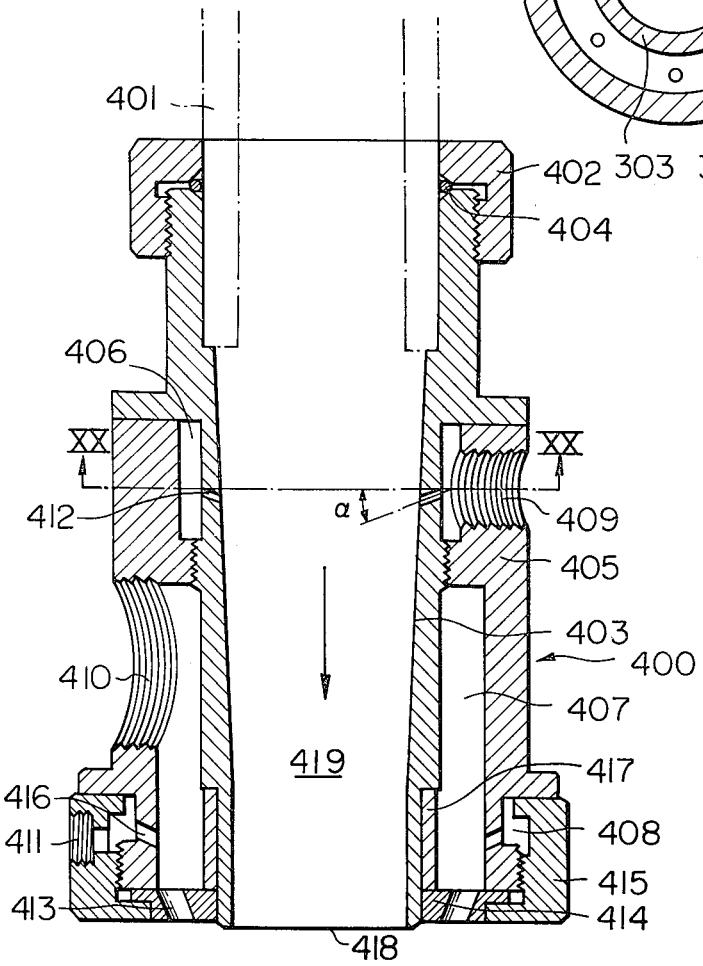
Figure 20:
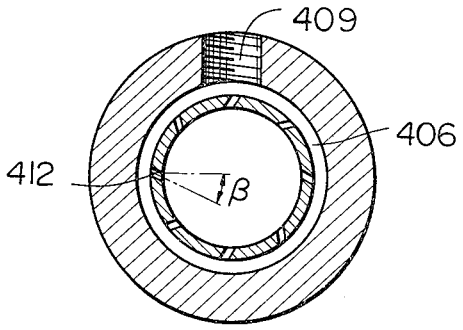
Figure 21:
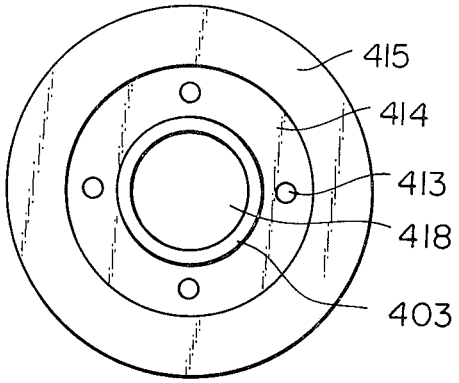
Figure 22:
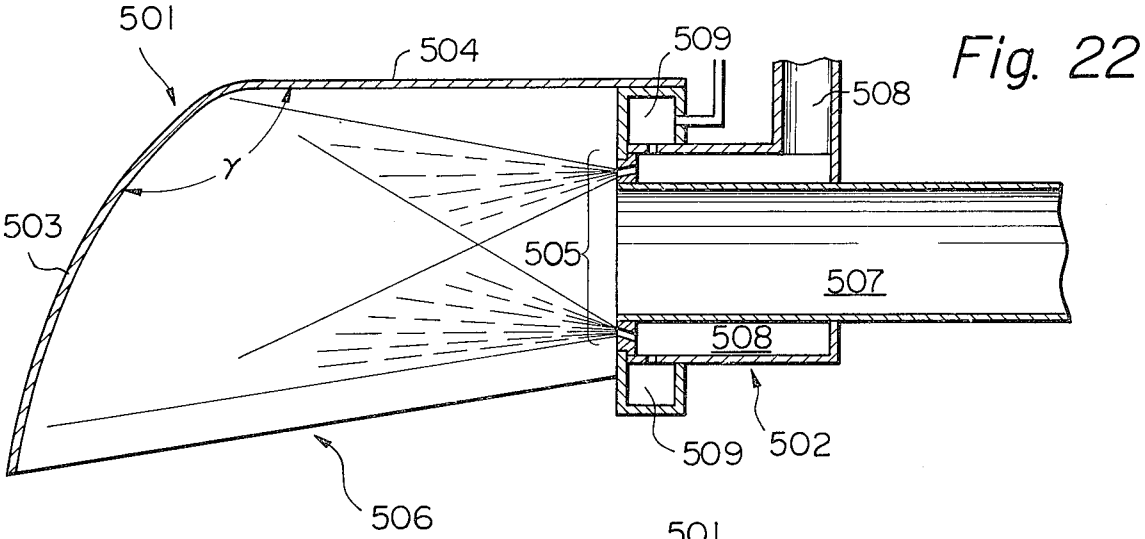
Figure 23:
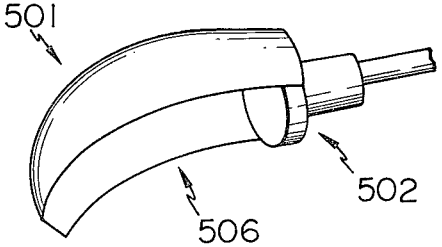

FIGS. 5-*a*, 5-*b* and 5-*c* are longitudinally sectional views showing the top ends of hoses of the glass fiber cutting and supplying means;

FIGS. 8-*a* and 8-*b* are plan and front views of a glass fiber cutting device that can be preferably applied to the apparatus of the present invention;

FIG. 9 is a diagram showing a second preferred embodiment of the apparatus of the present invention in the section taken along the line IX—IX in FIG. 10;

FIG. 10 is an end view of the apparatus of FIG. 9 seen from the left;

FIG. 11 is a view showing the section taken along the line XI—XI in FIG. 9;

FIG. 12 is a view showing the section of the central part of a third preferred embodiment of the present invention;

FIG. 13 is a bottom view of the apparatus shown in FIG. 12;

FIG. 14 is an end view showing the section taken along the line XIV—XIV in FIG. 12;

FIG. 15 is an end view showing the section taken along the line XV—XV in FIG. 12:

FIG. 16 is a view showing the section of the central part of a fourth preferred embodiment of the apparatus of the present invention;

FIG. 17 is a bottom view of the apparatus of FIG. 16:

FIG. 18 is a view showing the section taken along the line XVIII—XVIII is FIG. 16;

FIG. 19 is a view showing the section of the central part of a fifth preferred embodiment of the apparatus of the present invention;

FIG. 20 is an end view showing the section taken along the line XX—XX in FIG. 19;

FIG. 21 is a bottom view of the apparatus shown in FIG. 19, and;

FIGS. 22 and 23 are longitudinally sectional and perspective views, respectively, of a screening plate that can be preferably applied to the apparatus of the present invention.

Figure 1:
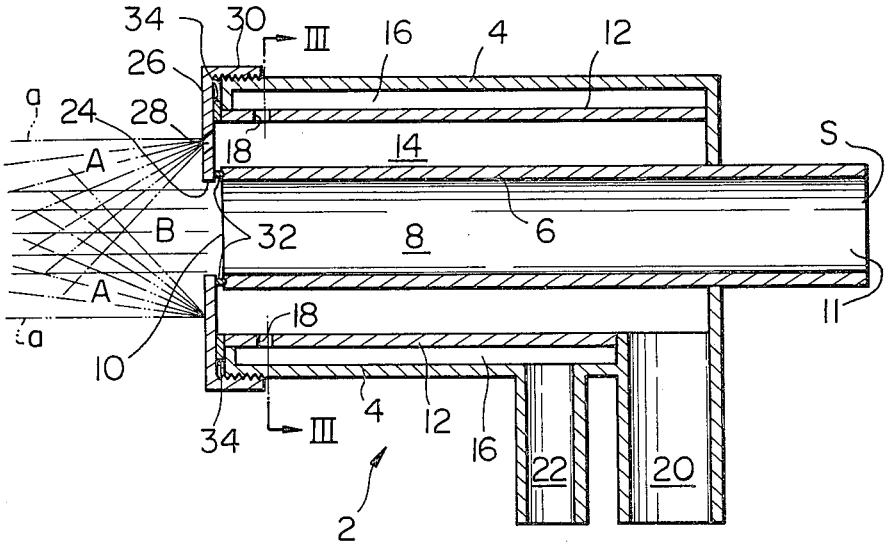
FIG. 1 is a diagram showing a first preferred embodiment of the apparatus of the present invention in the section taken along the line I—I in FIG. 2.
Figure 2:
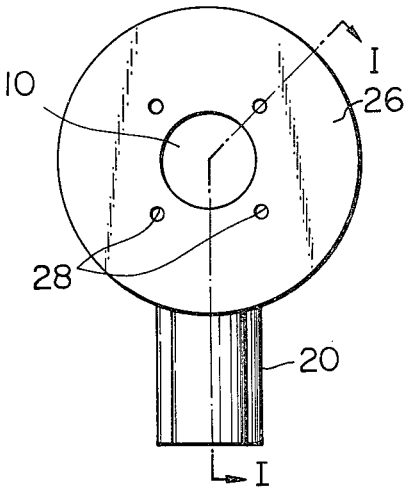
FIG. 2 is an end view of the apparatus of FIG. 1 seen from the left.
Figure 3:
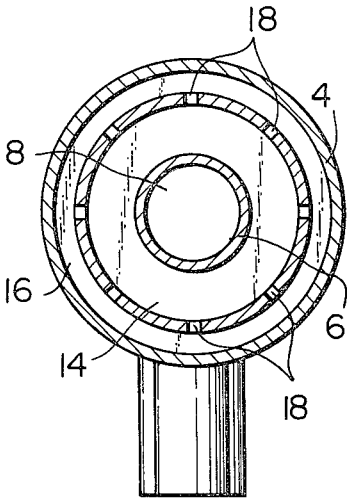
FIG. 3 is a view showing the section taken along the line III—III in FIG. 1.

Referring to FIGS. 1 to 3, a first preferred embodiment of the spray gun of the present invention is now described.

The apparatus for mixing a cement slurry with glass fibers has a drum 2 having a double tube structure, which includes an outer hollow cylinder 4 and an inner hollow cylinder 6 concentrically disposed in the outer cylinder 4. In the embodiment shown in the drawings, each of the outer cylinder 4 and the inner cylinder 6 has a hollow cylindrical structure, but they need not have a cylindrical shape. Namely, they may be elliptic or rectangular in section. The front end of the inner cylinder 6, the inside space of which constitutes a glass fiber supply passage 8, is opened to form a glass fiber discharge opening 10, and the rear end of the inner cylinder 6 is formed as a glass fiber inlet 11. A partition wall 12 of a cylindrical shape is disposed between the outer cylinder 4 and the inner cylinder 6 concentrically therewith, and the space inside the outer cylinder 4 is divided in a cement slurry supply passage 14 having an annular section and a compressed air introduction passage 16 having an annular section. In the vicinity of the front end of the partition wall 12 a plurality of holes 18 are formed so that they are spaced from one another at prescribed intervals in the circumferential direction. The compressed air introduction passage 16 is communicated with the cement slurry supply passage 14 through these holes 18 (see FIGS. 1 and 3). The outer cylinder 4 includes a cement slurry inlet 20 connected to the cement slurry supply passage 14 and a compressed air inlet 22 connected to the compressed air introduction passage 16. In the embodiment shown in the drawings, the space in the outer cylinder 4 is separated by the partition wall 12 to form the cement slurry supply passage 14 and the compressed air introduction passage 16 in the outer cylinder 4. It is, however, possible to adopt a structure in which a conduit is disposed outside the outer cylinder as the compressed air introduction passage 16 and the conduit is communicated in the vicinity of the front end of the outer cylinder 4 with the cement slurry supply passage 14 formed in the outer cylinder 4. The front end of the outer cylinder 4 is closed by a front end closing member 26 having at the center thereof an opening 24 registered with the glass fiber discharge opening 10. This front end closing member 26 has at least two injection holes 28 formed at the position corresponding to the position of the cement slurry supply passage 14. In the embodiment shown in the drawings, as specifically disclosed in FIG. 2, four injection holes 28 are annularly disposed so that they are spaced from one another at prescribed intervals. It is preferred that as shown in FIG. 2, they be equidistantly spaced from the center and be not located at lower parts corresponding to the position of the cement slurry inlet 20. It is also preferred that as illustrated in FIG. 1, these injection holes 28 be inwardly inclined so that the most external component of the injected cement slurry streams indicated by two-dot lines *a* is in parallel to the axial line of the inner cylinder 6 or inclined inwardly with respect to the axial line of the inner cylinder 6. The front end closing member 26 may be formed integrally with the outer cylinder 4, but in view of facilitation of such operations as the washing of the injection holes 28 and repairing and exchange of the closing member 26, it is preferred that the front end closing member 26 be dismountably attached to the front end of the outer cylinder 4 by, for example, forming a male thread on the outer face of the outer cylinder 4, forming a female thread on the inner face of a cylindrical part 30 of the front end closing member 26 and screwing the member 26 to the outer cylinder 4. As clearly illustrated in FIG. 1, sealing annular packings 32 and 34 are preferably disposed between the front end closing member 26 and the front end of the inner cylinder 6 and between the front end closing member 26 and the front end of the outer cylinder 4 respectively.

The cement slurry inlet 20 is connected to a supply hose of a known cement slurry feed device (not shown) provided with a feed pump, and the cement slurry is fed under pressure through the inlet 20 of the mixing apparatus to the cement slurry supply passage 14 by means of the feed pump of the cement slurry feed device. The compressed air inlet 22 is connected to an extrusion hose of an air compressor (not shown), and compressed air is fed through the inlet 22 to the compressed air introduction passage 16. The compressed air fed to the compressed air introduction passage 16 is introduced into the cement slurry supply passage 14 through a plurality of holes 18 and acts on the cement slurry fed under pressure to the cement slurry supply passage 14 and the cement slurry is injected in the form of a spray from the injection holes 28 as indicated by two-dot lines A. In order to inject the cement slurry in a desirable spray form, it is preferred that the injection holes by inclined toward the inner cylinder 6 by 5 to 45°, especially 10° to 30° and that the pressure of the compressed air be adjusted to 2 to 15 Kg/cm$^2$, especially 3 to 6 Kg/cm$^2$.

The inlet 11 of the inner cylinder 6, in the interior space of which the alkali-resistant glass fiber supply passage 8 is formed, is connected to a feed opening of a glass fiber cutting and feeding device. Any glass fiber cutting and feeding device can be used in the present invention, but in general, good results are obtained when devices of the type as shown in FIGS. 4, 6 or 7 are employed.

Figure 4:
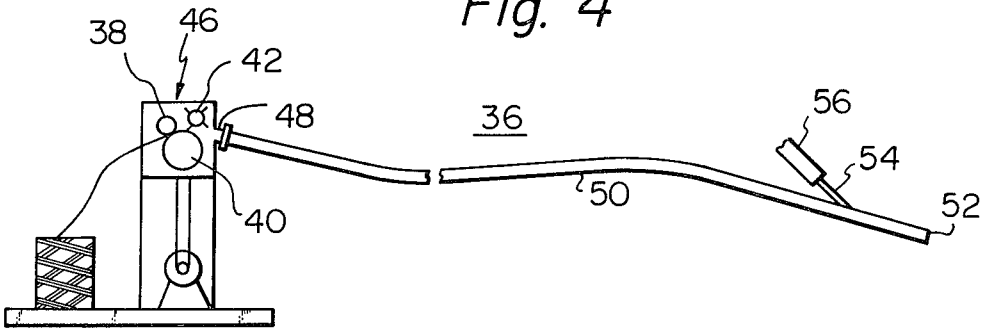

A glass fiber cutting and feeding device 36 shown in FIG. 4 includes a rotary cutter 46 for continuously cutting a glass fiber strand 44, which cutter 46 comprises a guide roller 38, a rubber roller 40 and a cutter roller 42. One end of a hollow conduit such as a flexible hose 50 is connected to a discharge opening 48 of the rotary cutter 46. In the vicinity of the other end of the hose 50 forming a feed opening 52 for cut glass fiber, there is disposed a fluid feed mechanism such as a compressed fluid feed nozzle 54. The number of compressed fluid feed nozzles 54 is not particularly critical, and one nozzle may be used as shown in FIG. 5-*a* or two or more nozzles may be disposed as shown in FIG. 5-*b*. Further, an annular nozzle such as shown in FIG. 5-*c* can be used. The nozzle 54 is connected to a compressed fluid source such as a compressor (not shown) through a conduit 56. As shown in FIG. 5-*a* the nozzle 54 penetrates to the interior of the hose 50 in the inclined state so that a compressed fluid is injected toward the feed opening 52. In this arrangement, when the compressed fluid is injected through the nozzle 54, the pressure in the hose 50 is reduced and the glass fiber cut by the cutter roller 42 and blown off to the discharge opening 48 is sucked from the discharge opening 48 to the feed opening 52 through the interior of the hose 50. The cut glass fiber is then fed from the feed opening 52 at a prescribed speed together with the compressed fluid injected from the nozzle 54. Then, the glass fiber is introduced into the inner cylinder 6 connected to the feed opening 52. In the above-mentioned glass fiber cutting and feeding device, it is preferred that the nozzle 54 be attached to the hose 50 so that the injection angle (the angle $\alpha$ in FIGS. 5-*a* to 5-*c*) is in the range of 10° to 40°, especially 20° to 25°. It has been found that especially good results are obtained when the nozzle is disposed at a point apart from the feed opening 50 by a distance of 15 to 50 cm, preferably 20 to 30 cm (the distance $L_1$ in FIGS. 5-*a* to 5-*c*). The diameter or length of the hose 50 is not particularly critical. However, in general, a hose having an inner diameter of 10 to 100 mm, preferably 20 to 35 mm, is employed, and the length is 5 to 30 m, preferably 10 to 15 m.

Figure 6:
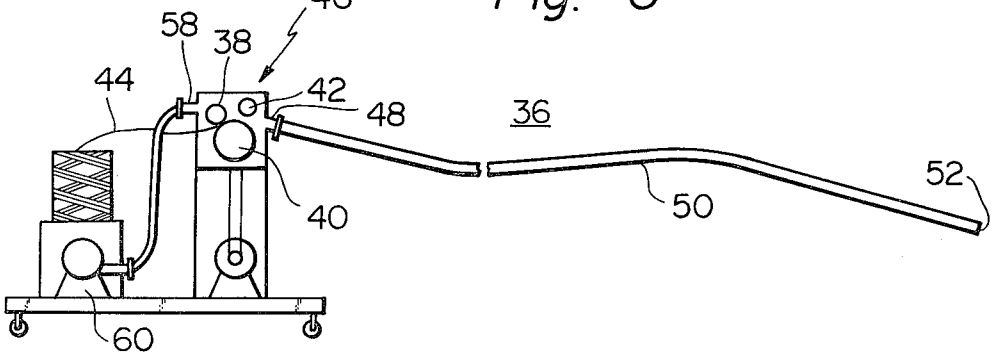

The glass fiber cutting and feeding device 36 shown in FIG. 6 is different from the device 36 shown in FIG. 4 in the point that a fluid supply conduit 58 is mounted on the rotary cutter 46, instead of the compressed fluid supply nozzle 54 being attached in the vicinity of the feed opening 52 of the hose 50, and a blower 60 is connected to the conduit 58. In the glass fiber cutting and feeding device 36 shown in FIG. 6, a fluid supplied to the fluid supply conduit 58 by the blower 60 is moved from the discharge opening 48 in the hose 50 together with the cut glass fiber and ejects the glass fiber from the feed opening 52 of the hose 50. Also in the device shown in FIG. 6, it is preferred that the hose 50 be flexible, but the diameter or length of the hose 50 is not particularly critical. In general, however, a hose having an inner diameter of 10 to 100 mm, preferably 20 to 35 mm, and a length of 5 to 30 m, preferably 10 to 15 m, is employed. The position of the attachment of the fluid supply conduit 58 is not particularly critical, but it is preferred that the conduit 58 be disposed at a position facing the discharge opening 48 through the guide roller 38, rubber roller 40 and cutter roller 42. It is preferred that the chamber of the rotary cutter 46 be formed to have such a shape that the fluid can flow smoothly from the supply conduit 58 to the feed opening 52.

The glass fiber cutting and feeding device 36 shown in FIG. 7 is one constructed by combining the device shown in FIG. 4 with the device shown in FIG. 6. More specifically, in the glass fiber cutting and feeding device 36 shown in FIG. 7, a compressed fluid supply nozzle 54 is attached to a hose 50 and a fluid supply conduit 58 is mounted on a rotary cutter 46, and by the interreaction of these nozzle 54 and conduit 58, the cut glass fiber is moved through the interior of the hose 50 and discharged from the feed opening 52. The structures of the hose 50, nozzle 54 and supply conduit 58 are as described hereinbefore with respect to the preceding embodiments.

A specially designed cutter need not be used as the rotary cutter 46 in the glass fiber cutting and feeding device shown in FIGS. 4, 6 or 7, and an ordinary rotary cutter can be used conveniently. This rotary cutter may be fixed at a prescribed position or may be mounted on a moving truck (see FIGS. 6 and 7). As the drive source of the rotary cutter, an air motor, an electric motor giving a stable low-speed rotation and other drive sources can be used in the present invention.

When a large quantity of a glass fiber is continuously fed, a rotary cutter 46 as shown in FIGS. 8-*a* and 8-*b* is preferably employed. The rotary cutter 46 shown in FIGS. 8-*a* and 8-*b* comprises a guide roller 38, a rubber roller 40, a cutter roller 42 and a chamber 64 having a fluid control plate 62 contained therein, and it has a capacity of cutting a glass fiber bundle 44 continuously and in a large quantity. The chamber 64 is communicated with a blower 60 through a fluid supply conduit 58. Two sets glass fiber cutting mechanisms, each including the guide roller 38, the rubber roller 40 and the cutter roller 42, are located in the chamber 64 and they are driven in directions reverse to each other by a drive source 66. The fluid fed from the blower 60 through the conduit 58 is distributed into the respective cutter rollers 42 by the fluid control plate 62, and the cut glass fiber is fed under pressure to a discharge opening 48. One end of a hollow conduit such as a flexible hose 50 as mentioned above is connected to the discharge opening 48 to feed the cut glass fiber to the apparatus for mixing it with the cement slurry.

It is preferred that the fluid be fed at a flow rate of 5.5 to 6.5 m$^3$/min from the blower 60 and the inner diameter of the fluid supply conduit and the discharge opening 48 be 2 inches.

The fluid control plate 62 is disposed so that the angle formed between the two lines extending from the fluid supply conduit 58 to the respective cutter rollers 42 is 90° to 180°, preferably 110° to 140°. The fluid control plate 62 may be formed to have a plate-like shape, a triangular shape or a curved shape, and the shape of the control plate 62, the position of the control plate 62 (the distance from the fluid feed opening of the conduit 58) and the distance between the fluid control plate 62 and each cutter roller 42 can optionally be decided appropriately according to the flow rate of the fluid supplied.

The rotation number of the cutter roller 42 is 300 to 2400 rpm, preferably 400 to 1500 rpm. The cut length of the glass fiber can optionally be changed by adjusting the distance between blades of the two cutter rollers 42. If a rotary cutter mechanism 46 having the above mentioned structure is used the maximum glass fiber feed rate is as high about 2000 g/min.

The glass fiber fed into the inner cylinder 6 by the above-mentioned glass fiber cutting and feeding mechanism 36 is passed through the glass fiber feed passage 8 in the interior of the inner cylinder 6 and discharged from the glass fiber discharge opening 10 as indicated by thin lines B in FIG. 1. In general, the glass fiber discharged from the glass fiber discharge opening 10 has a length of 10 to 50 mm and the fiber is discharged at a rate of 2 to 50 m/sec, preferably 10 to 40 m/sec. although the length and the discharge rate of the glass fiber is changed according to the intended use of resulting FRC.

The glass fiber stream B discharged from the discharge opening 10 impinges against the cement slurry stream A injected from the injection hole 28 as shown in FIG. 1. However, in the mixing apparatus of the present invention, at least two injection holes (four injection holes in the embodiment shown in FIGS. 1 to 3) are disposed outside the discharge opening 10 and, since at least two injected streams of the cement slurry A are present outside the glass fiber stream B, the glass fiber stream B located at the center under goes the actions of a plurality of the injected cement slurry streams A present around the stream B. Consequently, the glass fiber stream is incorporated into the cement slurry streams by a synergistic effect of the cement slurry streams and, as a result, the glass fiber is incorporated and dispersed in the cement slurry homogeneously. When the outermost stream *a* among these streams of the injected cement slurry is in parallel to the axial line of the inner cylinder 6 or inclined inwardly with respect to the axial line of the inner cylinder 6, the expansion of the streams of the glass fiber and the cement slurry is restricted in the region defined by the outermost streams *a* of the cement slurry. Namely, the FRC spray region is restricted and the mixture can easily be sprayed on an article or part having a configuration full of convexities and concavities. This is one of advantages attained by the present invention.

When the number of the injection holes located outside the discharge opening 10 is limited to two, it is advantageous to use injection holes 28 having an arc-like shape surrounding a part of the discharge opening 10.

Starting and stopping of the mixing spray apparatus of the present invention are performed in the following manner.

When a power switch is turned on, the circuits of a cement slurry feed pump, a glass fiber cutting device, a blower for glass fiber and an electromagnetic pneumatic valve connected to a compressed air feed source for cement slurry are closed to start the operation. A delay circuit is inserted in the circuit of the glass fiber cutting device so that the cutting device is actuated after the lapse of time $t_1$, generally 2 to 5 seconds, from the time of turning on of the power switch.

When the spraying operation has been continued for a prescribed period of time and the operation is stopped, the power switch is turned off. The fiber cutting device is first stopped and then, the cement slurry feed pump is stopped after a certain time $t_2$, generally 1 to 4 seconds. After this stopped state of the cement slurry feed pump has continued for a certain time $t_3$, generally 3 to 5 seconds, the pump is again operated in the reverse direction for a certain time $t_4$, generally 2 to 5 seconds. Thus, the circuits are so arranged that the cement slurry feed pump is completely stopped after the reverse rotation continued for the certain time $t_4$. After the cement slurry feed pump has been completely stopped, the blower for glass fiber and the electromagnetic pneumatic valve connected to a compressed air feed source for cement slurry are de-energized and the apparatus is entirely stopped.

The second preferred embodiment of the spray gun of the present invention will now be described with reference to FIGS. 9 to 11.

The apparatus for mixing a cement slurry with glass fiber, illustrated in FIGS. 9 to 11, has a double tube structure drum 102 including an outer hollow cylinder 104 and an inner hollow cylinder 106 disposed in the outer cylinder 104 concentrically therewith. The front end of the inner cylinder 106, in the hollow interior of which a glass fiber feed passage 108 is formed, is opened to form a glass fiber discharge opening 110, and at the rear end of the inner cylinder 106 is formed a glass fiber inlet 111. As shown in FIGS. 9 and 10, for example, four projections 113 may be formed at the front end of the inner cylinder 106 constituting the glass fiber discharge opening 110 so as to cause turbulence in the stream of the glass fiber discharged from the opening 110. In the space between the outer cylinder 104 and the inner cylinder 106, there are disposed at least two hollow tubes 112 (four tubes in the embodiment shown in the drawings) having preferably a cylindrical form, so that the space in the outer cylinder 104 is divided into cement slurry feed passages 114 in the hollow tubes 112 and a compressed air introduction passage 116 outside these hollow tubes 112. Two holes 118, for example, are formed in the vicinity of the front end of each hollow tube 112, and the compressed air introduction passage 116 is communicated with the cement slurry supply passages 114 through these holes 118. The outer cylinder 104 further comprises a cement slurry inlet 120 communicated with the cement slurry feed passage 114 and a compressed air inlet 122 communicated with the compressed air introduction passage 116. The front end of the outer cylinder 104 is closed by a front end wall 126, and this front end wall 126 has at the center thereof an opening through which the inner cylinder 106 is disposed. In the front end wall 126, openings 127 for attachment of injection hole members is formed at the position registered with the position of the cement slurry feed passage 114. Injection hole members 129 each having an injection hole 128 are screwed to these openings 127. The injection holes 128 may be formed directly on the front end wall 126 without using such injection hole members 129. In the embodiment shown in the drawings, the front end wall 126 is formed integrally with the outer cylinder 104, but the front end wall 126 can be dismountably attached to the outer cylinder 104. As in case of the embodiment shown in FIGS. 1 to 3, it is preferred that the injection holes 128 be inwardly inclined at an angle of 10° to 30° so that the outermost stream among the injected streams of the cement slurry is in parallel to the axial line of the inner cylinder 106 or inclined inwardly with respect to the axial line of the inner cylinder 106.

As in case of the mixing apparatus shown in FIGS. 1 to 3, the cement slurry inlet 120 is connected to a feed hose of the cement slurry feed device and the compressed air inlet 122 is connected to an extrusion hose of the air compressor. The compressed air fed into the compressed air introduction passage 116 is passed through a plurality of holes 118 and introduced into the cement slurry supply passage 114 and causes the cement slurry fed under pressure to the passage 114 to be injected in spray form from the injection holes 128. The glass fiber inlet 111 is connected to a feed opening of a glass fiber cutting and feeding device as shown in FIGS. 4, 6 or 7, and glass fiber is fed from the inlet 111 and discharged from the discharge opening 110. At this point, the stream of the discharged glass fiber is disturbed by the projections 113 and is discharged in turbulent flows directed outwardly as indicated by thin lines B in FIG. 9.

As in case of the apparatus shown in FIGS. 1 to 3, the discharged glass fiber stream B from the discharge opening 110 positioned at the center impinges against several cement slurry streams A injected from the injection holes 128 located around the discharge opening 110, and the glass fiber stream B is incorporated in a good condition into the cement slurry streams A by the synergistic effect thereof. As a result, the glass fiber is incorporated and dispersed homogeneously into the cement slurry.

The third preferred embodiment of the spray gun of the present invention will now be described with reference to FIGS. 12 to 15.

The apparatus for mixing a cement slurry with glass fiber, illustrated in FIGS. 12 to 15, comprises a hose 201 having a circular section, which is connected to a pneumatic glass fiber feed source (not shown), a cylindrical joint 202 for connection of the hose 201, an inner hollow cylinder 203 having a circular section, which constitutes a fiber feed passage, an O-ring 204 for fixation of the hose 201 which is disposed on the inside of the joint 202 screwed onto the inner hollow cylinder 203, and an outer hollow cylinder 205 disposed outside the inner hollow cylinder 203. Namely, the mixing apparatus has a drum 200 having a double tube structure, which includes the outer hollow cylinder 205 and the inner hollow cylinder 203. A cement slurry feed passage 206 is formed in the space between the outer cylinder 205 and the inner cylinder 203, and a cement slurry inlet 207 is disposed on the outer cylinder 205 and is connected to a cement slurry feed source (not shown). The upper end of the cement slurry feed passage 206 is closed, and on the lower end of the passage 206, a nozzle 209 having at least two spray holes 208 inclined at a certain angle with respect to the fiber discharge direction of a glass fiber feed passage 221 is disposed to form a closed face. A compressed air hole 210 is formed in the interior of the outer cylinder 205 in the vicinity of the nozzle 209, and this hole 210 is connected to a compressed air inlet 212. This inlet 212 is formed on a door end cap member 211 for attachment and dismounting of the nozzle 209 and is communicated with a compressed air source (not shown). An O-ring 213 is disposed to seal the compressed air and O-rings 214 and 215 are disposed to seal the cement slurry. A protective ring 216 composed of an abrasion-resistant material is disposed on the outer circumference of the inner cylinder 203 at the position corresponding to the position of the compressed air hole 210.

On the nozzle 209, two to eight spray holes (four holes in the embodiment shown in the drawings) are formed equidistantly on one circle. It is preferred that the diameter of each hole be 4 to 6 mm and the angle of inclination to the axial line of the cylinder be 10° to 30°. Four to twelve compressed air holes 210 (eight holes in the embodiment shown in the drawings) are disposed equidistantly in the circumferential direction of the outer cylinder 205, and in the embodiment shown in the drawings, one compressed air inlet 212 is formed on the door end cap member 211 and this inlet 212 is communicated with the compressed air holes 210 through a compressed air introduction passage 220 formed on the circumference of the outer cylinder 205 along the circumferential direction thereof.

In the spray gun of the above illustrated embodiment, fibers 217 pneumatically fed by compressed air are introduced into the inner cylinder 203 through the hose 201, while a cement slurry 219 is introduced into the cement slurry feed passage 206 through the cement slurry inlet 207 and is injected toward the glass fiber stream from the spray holes 208 by compressed air fed under pressure from the compressed air hole 210. As a result, the fibers 217 are incorporated into the slurry 219 in the state where the central fiber stream is surrounded by the cement slurry streams.

In this embodiment, a protective ring 216 composed of an abrasion-resistant material is formed on the outer circumference of the inner hollow cylinder as pointed out hereinbefore. By provision of this protective ring, damage to the inner cylinder by the pressure of the compressed air can be prevented and condition of the injected streams can be completely prevented from changing with the lapse of the time.

The fourth preferred embodiment of the mixing apparatus, which is a modification of the apparatus of the above third preferred embodiment, will now be described with reference to FIGS. 16 to 18.

In the apparatus for mixing a cement slurry with glass fiber, illustrated in FIGS. 16 to 18, a hose 301 having a circular section is connected to a glass fiber pneumatic feed source (not shown), a cylindrical joint 302 is disposed to connect this hose 301 to the mixing apparatus, an inner hollow cylinder 303 having a circular section is disposed to form a fiber feed passage, the joint 302 is screwed onto the inner cylinder 303 and an O-ring 320 is disposed on the inside of the joint 302 for fixation of the hose 301. An outer hollow cylinder 305 is disposed outside the inner cylinder 303 to form a double tube structure drum 300. In the space between the outer cylinder 305 and the inner cylinder 303, a cement slurry feed passage 306 is formed and a cement slurry inlet 307 is formed on the outer cylinder 305 and is connected to a cement slurry feed source (not shown). On the lower end of the cement slurry feed passage 306, a nozzle 309 having at least two injection holes 308 inclined at a certain angle with respect to the fiber discharge direction of the glass fiber feed passage 322 is disposed to form a closed face. The nozzle 309 is closely fixed to the inner cylinder 303 and the outer cylinder 305 by a door end closing member 311 for attachment and dismounting of the nozzle 309. Two to eight injection holes 308 (four holes in the embodiment shown in the drawings) are formed equidistantly on the nozzle 309 on one circle. It is preferred that the diameter of each of the holes 308 be 4 to 6 mm and the angle of inclination of each hole 308 with respect to the axial line of the cylinder be 10° to 30°.

A closed face is formed on the rear end of the cement slurry feed passage 306 by a partition wall 304 having a compressed air hole 310, and this rear end is connected to a upper end closing member 321 dismountably disposed.

In the embodiment illustrated in the drawings, one compressed air inlet 312 is formed on the upper end closing member 321, and the compressed air inlet 312 is communicated with the compressed air hole 310 through a compressed air introduction passage 316 defined by the partition wall 304, the upper end closing member 321 and the inner cylinder 303. One to twelve compressed air holes 310 (eight holes in the embodiment shown in the drawings) are formed on the partition wall 304.

An O-ring 313 is disposed to seal the compressed air and O-rings 314 and 315 are disposed to seal the cement slurry.

In the spray gun apparatus of the above illustrated embodiment, the glass fibers 317 fed pneumatically by compressed air are introduced into the inner cylinder through the hose 301 and discharged from the fiber discharge opening 318. The cement slurry 319 is introduced into the cement slurry feed passage 306 through the cement slurry inlet 307, pushed away by compressed air fed under pressure from the compressed air holes 310 and injected toward the glass fiber stream from the spray holes 308. As a result, the glass fiber stream is incorporated into the cement slurry streams in the state where the fiber stream is surrounded by the cement slurry streams.

In this embodiment, since the compressed air holes are located to the rear of the cement slurry inlet, remainder of the cement slurry left in the cement slurry feed passage is reduced by the pushing force of the compressed air and smooth flowing of the cement slurry is promoted. As a result, adherence of the cement slurry to the inner wall of the cement slurry feed passage and solidification of the cement slurry can be effectively prevented, and the cement slurry can be fed stably even if the operation is continued for a long time.

The fifth preferred embodiment of the mixing apparatus of the present invention, which is another modification of the above illustrated third preferred embodiment, will now be described with reference to FIGS. 19 to 21.

In the spray gun apparatus for mixing a cement slurry with glass fiber, illustrated in FIGS. 19 to 21, a hose 401 having a circular section is connected to a glass fiber pneumatic feed source (not shown). A cylindrical joint 402 is disposed to connect the hose 401 to the mixing apparatus. An inner hollow cylinder 403 is disposed to form a fiber feed passage and has a circular section.

The joint 402 is screwed onto the inner cylinder 403 and has on the inside thereof an O-ring. An outer hollow cylinder 405 is disposed outside the inner cylinder 403 to form a double tube structure drum 400. In the space between the outer cylinder 405 and the inner cylinder 403, there are separately disposed along the circumferential wall of the inner cylinder 403 a compressed air feed passage 406, a cement slurry feed passage 407. A compressed air introduction passage 408 is disposed between the outer cylinder 405 and a cap member 415. The outer cylinder 405 includes a compressed air inlet 409 connected to a compressed air feed source (not shown), a cement slurry inlet 410 connected to a cement slurry feed source (not shown) and the cement slurry pneumatic feed compressed air inlet 411 connected to the compressed air source (not shown).

The compressed air feed passage 406 is connected to at least two compressed air injection holes 412 for causing turbulences in the glass fiber stream. It is preferred that the angle $\alpha$ of inclination of each of the compressed air injection holes to the fiber discharge direction be 0 to 45°, especially 5° to 10°, with respect to the normal line of the outer cylinder 405 and the angle formed between the injection hole 412 and the center of the fiber feed passage be 15° to 75°, especially 30° to 60°. It is also preferred that the inner diameter of each injection hole 412 be 0.4 to 2 mm, especially 0.5 to 1 mm, and that four to eight of such injection holes be provided.

A closed face is formed on the lower end of the cement slurry feed passage 407 by a nozzle 414 including at least two injection holes 413 inclined at 5° to 45°, preferably 10° to 30°, with respect to the fiber discharge direction of the glass fiber feed passage 419. The nozzle 414 is closely fixed to the inner cylinder 403 and the outer cylinder 405 through a lower end cap member 415 for attachment and dismounting of the nozzle 414, and compressed air holes 416 are formed in the cement slurry feed passage 407 in the vicinity of the nozzle 414 to connect the passage 407 with the compressed air feed passage 408. Two to eight injection holes 413 are formed equidistantly on the nozzle 414, and it is preferred that the diameter of each of these injection holes 413 be 4 to 6 mm. It is preferred that four to twelve compressed air holes 416 be formed equidistantly in the circumferential direction of the outer cylinder 405 (eight holes are formed in the embodiment shown in the drawings). A protective ring 417 composed of a corrosion-resistant material is disposed on the periphery of the inner cylinder 403 at the position corresponding to the position of the compressed air holes 416.

In the mixing apparatus of the above illustrated embodiment, a discharged stream of the glass fibers fed pneumatically by the compressed air impinges against compressed air streams injected from the injection holes 412 formed on the inner cylinder 403, and turbulences are formed in the fiber stream. As a result, an air stream in which the glass fibers are dispersed homogeneously is formed. This fiber-dispersed compressed air stream is discharged from a fiber discharge outlet 418.

The cement slurry is introduced into the cement slurry feed passage 407 from the cement slurry inlet 410 and injected toward the above fiber-dispersed compressed air stream from the injection holes 413 by compressed air injected from compressed air injection holes 416, whereby the glass fiber is incorporated and dispersed homogeneously in the cement slurry.

The mechanism for causing turbulence in the glass fiber stream and dispersing the glass fibers homogeneously is not limited to the means described above, and any mechanism can optionally be adopted according to the fiber discharge device used.

When a mixture of a cement slurry and a glass fiber is injected onto a molding frame having an opening smaller in size than the injection area, for example, a cylindrical molding frame, by using the mixing apparatus of the present invention, a screening plate is fixed to the door end of the mixing apparatus to narrow the injection area in accordance with the size of the opening of the molding frame, and a homogeneous mixture of the cement slurry and the glass fibers is injected and applied onto the molding frame.

A preferred embodiment of this screening plate will now be described by reference to FIGS. 22 and 23.

Referring now to FIGS. 22 and 23, a screening plate 501 to be fixed to the apparatus for mixing a cement slurry with glass fiber includes a screening member 503 disposed in front of the mixing apparatus 502 in the injection direction to screen the injected stream and a supporting member 504 for supporting this screening member 503. The supporting member 504 is fixed in the vicinity of an injection opening 505 of the mixing apparatus 502 and the angle $\gamma$ of the screening member 503 to the supporting member 504 is at least 90°. An opening 506 is formed on one side of the space defined by the mixing apparatus 502 and the members 503 and 504. It is preferred that the screening member 503 be located at a point distant from the injection opening 505 by a length shorter than 500 mm, especially shorter than 250 mm.

In the above arrangement, the glass fiber discharged from the glass fiber feed passage 507 and the cement slurry injected from the slurry supply passage 508 by compressed air injected from the compressed air introduction passage 509 are mixed together homogeneously, and the mixed stream is screened by the screening member and applied to the molding frame through the opening 506. The size of the opening 506 is appropriately adjusted according to the size of the molding frame used.

What we claim is:

1. A spray gun for mixing a cement slurry with glass fiber in order to produce a glass fiber reinforced-cement, said spray gun comprising:

a body having a glass fiber supply passage formed as an innermost hollow element, one end of said passage being adapted for connection with means for cutting glass fiber and means for supplying cut glass fiber to said passage by compressed air, the other end of said passage forming a discharge opening for said cut glass fibers;

said body having an outermost hollow element formed concentrically of said glass fiber supply passage;

said body having a cement slurry supply passage provided in the concentric space formed between the innermost hollow element and the outermost hollow element which passage is adapted for connection to cement slurry feeding means;

an air introduction passage formed in the outermost hollow element and communicating with said cement slurry supply passage through a plurality of air introduction holes, said outermost hollow element being adapted for connection to compressed air supply means;

a closing element provided between the periphery of said discharge opening of the innermost hollow element and the periphery of one end of the outermost hollow element and arranged in such a manner that said closing element is perpendicular to the common axial line of said innermost and outermost hollow elements; and at least two injection holes provided in said closing element wherein each of said injection holes is inwardly inclined with respect to the direction in which the cut glass fibers flow in said glass fiber supply passage and communicating with said cement slurry supply passage so as to cause cement slurry discharged therefrom by compressed air to be directed parallel to and inwardly toward the axial line of said glass fiber supply passage and mixed with cut glass fibers discharged from the discharge opening of the glass fiber supply passage, and wherein said air introduction holes are proximate at least two diametrically opposite cement slurry injection holes.

2. A spray gun as set forth in claim 1, wherein said inner and outer hollow elements are cylindrical hollow pipe members.

3. A spray gun as set forth in claim 2, wherein said closing member consists of a cap member removably mounted on the outer pipe member.

4. A spray gun as set forth in claim 2, wherein said compressed air introduction passage is formed between the outer pipe member and an annular partition wall concentrically positioned between said outer pipe and inner pipe, said partition wall being provided with a plurality of said air introduction holes.

5. A spray gun as set forth in claim 2, wherein each of said injection holes is arranged at the same distance from each other and from the common center axial line of said pipe members.

6. A spray gun as set forth in claim 5, wherein each of said injection holes is arranged in such a manner that none of said holes is located at a portion of said closing member corresponding to the position of a cement slurry inlet communicated with said cement slurry supply passage.

7. A spray gun as set forth in claim 5, wherein each of said injection holes is inwardly inclined with respect to the direction in which the cut glass fibers flow in said glass fiber supply passage, at an angle of 5° to 45°.

8. A spray gun as set forth in claim 7, wherein the angle is from 10° to 30°.

9. A spray gun as set forth in claim 1, wherein the diameters of said injection holes are 4 to 6 mm.

* * * * *